United States Patent [19]

Rummer

[11] 4,041,818

[45] Aug. 16, 1977

[54] APPARATUS FOR CUTTING CARPET SAMPLES

[76] Inventor: Jurgen Rummer, Industriestr 8, 8602 Trosdorf, Bamberg, Germany

[21] Appl. No.: 680,571

[22] Filed: Apr. 26, 1976

Related U.S. Application Data

[63] Continuation of Ser. No. 557,265, March 11, 1975, abandoned.

[51] Int. Cl.[2] ..... B26D 3/02; B26D 7/06; B26D 11/00

[52] U.S. Cl. ..... 83/256; 83/404; 83/517; 83/574; 83/581; 83/829

[58] Field of Search ..... 83/256, 404, 513, 519, 83/574, 581, 829, 517

[56] References Cited

U.S. PATENT DOCUMENTS

| | | | |
|---|---|---|---|
| 1,629,233 | 5/1927 | Strelne | 83/256 X |
| 3,596,548 | 8/1971 | Nagal | 83/404 X |
| 3,688,619 | 9/1972 | Yabuta | 83/404 X |
| 3,826,164 | 7/1974 | Campbell | 83/256 X |

*Primary Examiner*—Frank T. Yost
*Attorney, Agent, or Firm*—Arnold Grant

[57] ABSTRACT

A device and a process for the progressive dividing of carpet webs or the like into square sample pieces of any desirable dimensions with chamfered edges.

15 Claims, 7 Drawing Figures

APPARATUS FOR CUTTING CARPET SAMPLES

This application is a continuation of application Ser. No. 557,265, filed Mar. 11, 1975, now abandoned.

The present invention relates to a process and a device for the progressive dividing of carpet webs or similar woven structures into sample pieces of any desirable dimensions with chamfered edges.

In order to provide a potential purchaser with an idea of the outward and esthetic appearance of a carpet or similar woven structure, it is desirable to provide sample pieces thereof. Such sample pieces are usually cut in a rectangular configuration and are filed in corresponding sample maps. Carpet webs usually have a base layer into which the nap is embedded. In order to avoid an unravelling of the nap at the lateral edges of the sample pieces, it is necessary to chamfer the cut lateral edges in the region of the nap.

Devices for dividing carpet webs, which perform a cutting dividing process by means of rotating knives are already known. However, these known devices do not themselves perform a chamfering of the edges; the edges have to be chamfered by hand after separation of the sample pieces. This is not only complicated and thereby expensive, but also inaccurate. Moreover, the known devices present further disadvantages in that the rotating knives are set at a certain predetermined distance apart corresponding to the width or length of the sample piece to be cut. If the dimensions of the sample pieces are to be changed, it is necessary to dismount the shaft bearing the rotating knives, to change the distance between the individual knives, and to remount the shaft into the device. Furthermore, the process of dividing the carpet causes frictional overheating which itself causes a dissolving or smearing of the carpet web in the region of the cutting point. The sample piece produced in this manner presents an unaesthetic appearance; equally as important, there will be a change of the structure in the region of the lateral edges, so that the potential purchaser may not get an accurate impression of the appearance of the carpet and its structure from each sample piece.

Therefore, it is an object of the present invention to provide a process and a device which avoids each of the aforementioned disadvantages.

According to the invention, there is provided a process for progressively dividing carpet webs or similar woven structures hereinafter jointly referred to as carpet webs, which carpet webs comprise an upper and a lower layer into rectangular sample pieces of desired dimensions with chamfered edges, Wherein the carpet web is first fed, is then cut transverse to the feed direction into strips, and subsequently the strips are straightened parallel to the feed direction and are cut into pieces of predetermined length, whereby each cutting process comprises a diagonal cut over the total thickness of the work piece and a subsequent vertical cut through the lower layer of the work piece.

According to the invention, there is also provided a device for carrying out the above process comprising a main frame; a conveying table mounted on the main frame and on which the carpet web will be supported and fed; four cutting tools, each pivotable about an axis transverse to the direction of the feed at that cutting tool, for cutting the carpet web into sample pieces and for chamfering the cut edges thereof, said cutting tools being arranged into a first pair for fashioning two opposite edges of the sample pieces and a second pair for fashioning the other two opposite edges of the sample pieces; and, between said first and second pairs of cutting tools, a straightening station for aligning carpet strips produced by the first pair of cutting tools in the direction of feed into the second pair of cutting tools.

In a particular embodiment of the invention the conveying table, in plan view, is of substantially L-shaped configuration thereby involving a substantially perpendicular change of feed direction, the straightening station being arranged in the region of the junction of the two legs of the L-shape, and comprising several liftable and lowerable cylinders parallel to a first and consequently transverse to a second feed direction and arrange to pass vertically through a conveying device for the first feed direction. In this embodiment, each for the two table legs has a pair of cutting tools for cutting and chamfering the front and rear edge of the sample piece, on the one hand, and the two lateral edges of the sample piece, on the other hand. The cutting tools may each comprise an elongate blade arranged transverse to the table and provided with a cutting edge, and an associated stationary blade for cooperation with said elongate blade.

Each cutting tool may be arranged within a support, formed by lateral supports which are piviotable mounted on the main frame and by a cross-piece extending between the lateral supports and rigidly connected with same. Additionally, each cutting tool is associated with a working cylinder to actuate the cutting tool and thereby move it through its cutting stroke, and each cutting tool has column guides on both sides. The main frame in this embodiment comprises rectangular hollow sections which are laterally enlarged in the vicinity of the cutting tools; the enlarged portions being formed as U-shaped intermediate carries, also of rectangular hollow section, and each being provided with a clamp jack on the upper side. The clamp jacks each have a stud rigidly attached thereto which engages with respective bearings at the lateral supports of the support carrying the cutting tools, thereby forming the swivel axes for the cutting tools. The working cylinders for horizontal swing and adjustment of the cutting tools are situated adjacent to the enlarged portions of the main frame.

An embodiment of the invention will now be described by way of example with reference to the accompanying drawings, in which.

Figure 3:
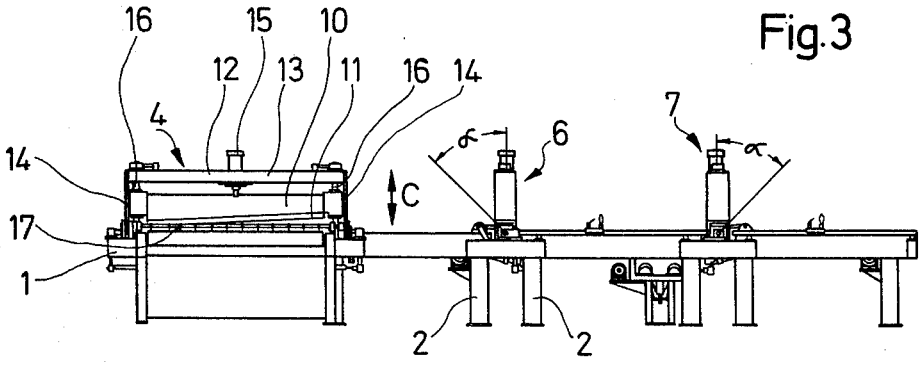
FIG. 3 is a side view of the device shown in FIG. 1 as seen in the direction III.
Figure 1:
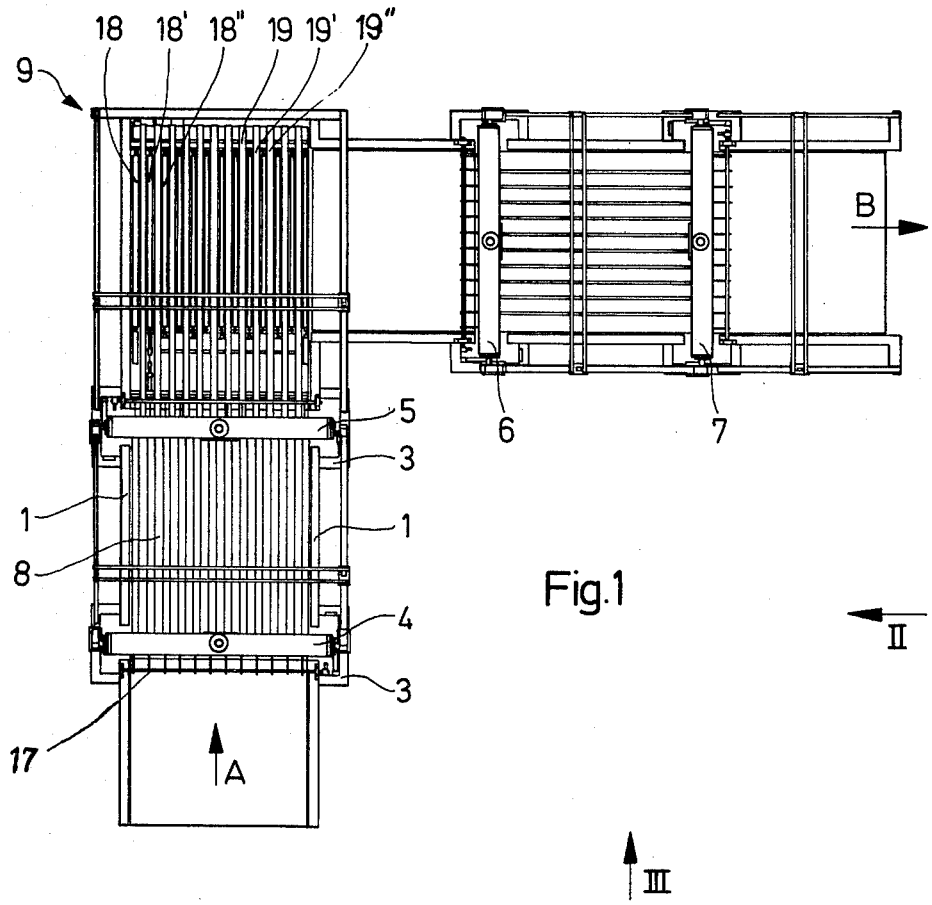
FIG. 1 is a plan view of a device according to the invention for progressively dividing carpet webs into rectangular sample pieces.
Figure 2:
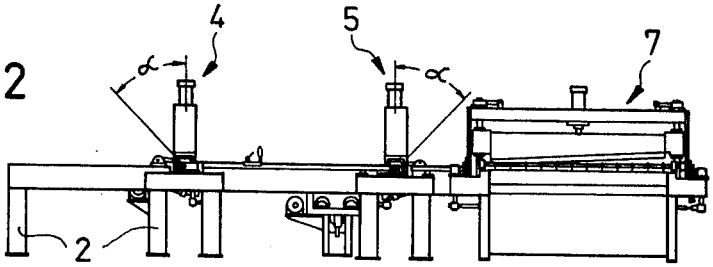
FIG. 2 is a side view of the device shown in FIG. 1 as seen in the direction II.

Looking now to FIGS. 1 - 3 there is shown a machine for producing sample pieces of carpets formed in a substantially L-shaped configuration. The machine comprises a main frame 1 supported by legs 2, enlarged portions 3 and four cutting tools 4, 5, 6, and 7. Within the lap scope of the two legs of the table 8, supported by the main frame 1, is arranged a straightening station 9, which is referred to in detail hereinafter. The feed direction of the working pieces is indicated in FIG. 1 by the arrows A and B. The front and rear edge as well as the lateral edges of each sample piece are cut and worked by each one of the cutting tools 4 to 7.

The cutting tools 4 to 7 are each pivotable about an axis transverse to the feed direction, through an angle $\alpha$, as also described hereinafter. They are all similar in construction. The construction of the cutting tools 4 to 7 shall be illustrated in detail with reference in particular to the cutting tool 4 (see FIG. 3). As can be best seen in FIG. 3, the cutting tools each comprise an elongage blade 10 provided with a cutting edge 11 arranged transversally to the table, and within a support 12.

The support 12 comprises a cross-piece 13 rigidly connected to lateral supports 14, which are, in turn, pivotably mounted upon the main frame 1. A working cylinder 15 which may be actuated by any usual means (mechanical or electrical) not shown, is connected to the blade 10 by means of a piston rod, and moves the blade back and forth in the direction of the double arrow C. The blade 10 is guided on both sides in columns 16 arranged within the support 12. Adjacent each of the cutting tools a blankholder 17, which serves to retain the carpet web to be cut or the stips and pieces already cut; the construction of the blankholder 17 is more fully described in detail below, with particular reference to FIG. 4.

In operation, the work pieces of carpet are conveyed in the direction of arrow A and cut into strips by cutting tool 4; then after passing cutting tool 5 they arrive at straightening station 9, which straightens the strips for movement in the feed direction of arrow B, perpendicular to the feed direction of arrow A. The straightening station 9 comprises a series of raisable and lowerable cylinders 18, 18', 18'' etc. arranged parallel to feed direction A. The length of the cylinders 18, 18', etc. corresponds to the breadth of the table 8. A plurality of uniformly spaced conveyors 19, 19', etc. is also positioned at the straightening station 9 for feed movement in direction A. Cylinders 18, 18', etc. Are positioned between conveyors 19, 19', etc. such that they can pass vertically between the conveyors 19, 19'. As soon as a desired number of strips cut by the cutting tools 4 and 5 are chamfered by means of the cutting edges arrive at the straightening station 9, the cylinders 18, 18' etc. are lifted, pass upwards between the conveyors 19, 19' etc. and supply the strips, now parallel to feed direction B, to the cutting tools 6 and 7. Cutting tools 6 and 7 then cut the strips into pieces corresponding to the required length of the sample pieces and automatically chamfer the edges of the sample pieces after a horizontal swing of the cutting tools. As is shown most clearly in FIG. 4, the main frame 1 is enlarged in the region of each of the cutting tools 4 to 7. These enlargements are formed as U-shaped intermediate carriers 20, laterally projecting from the main frame 1 and bridging the main frame 1, which is interrupted at this location. The enlargements consist, similar to the frame 1, of a hollow section of rectangular cross-section; this may best be seen in FIG. 5.

Figure 5:
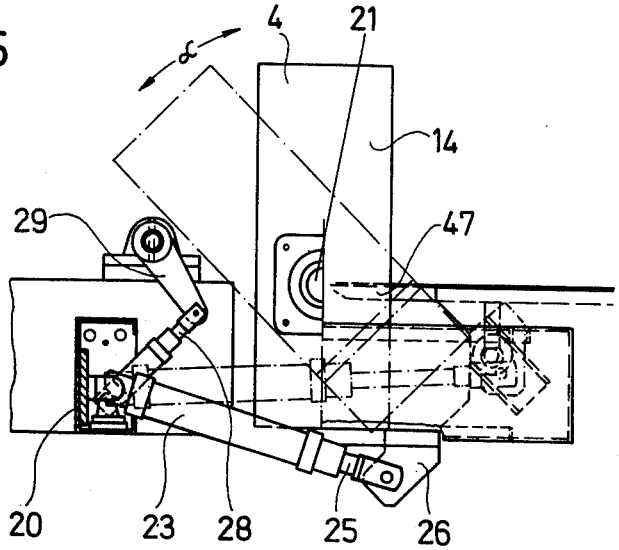
FIG. 5 is a partially sectioned side view of the detail shown in FIG. 4, according to the section line V-V.

Within the enlarged parts of the main frame 1, the cutting tool — in the present case the cutting tool 4 — is pivotably arranged. FIG. 5 shows one of the lateral supports 14 provided with a bearing hole 21, in which a stud is located, arranged rigidly in a clamp jack 22. The particular construction and arrangement of the clamp jack 22 will be described hereinafter below.

Working cylinders 23, each of which is pivotably mounted at one end inside the hollow section of the intermediate carrier 20 by means of mounting bracket 24 are arranged to swing the cutting tool about a horizontal axis for chamfering the edges of the sample pieces. The piston rod 25 projecting from the working cylinder 23 and connected with the piston contained therein is pivotally fixed to a swivel lever 26, which is connected with the cutting tool 4. When the working cylinder 23 is actuated by means not shown (such as mechanically or electrically) it swings the cutting tool 4 about the angle $\alpha$, so that the cutting tool 4 comes into the position shown in broken lines in FIG. 5.

Working cylinder 27, adjacent cylinder 23 is also mounted at one end inside the hollow section of the intermediate carrier 20, and has its piston rod 28 pivotably connected with a swivel lever 29. The swivel lever 29 is fixedly connected with a blankholder 30, which presses the carpet web, or, its cut pieces to the table 8 during the cutting and chamfering process. The blankholder 30 comprises a swivel rod 31 rigidly connected struts 32 and holding bar 33.

Figure 4:
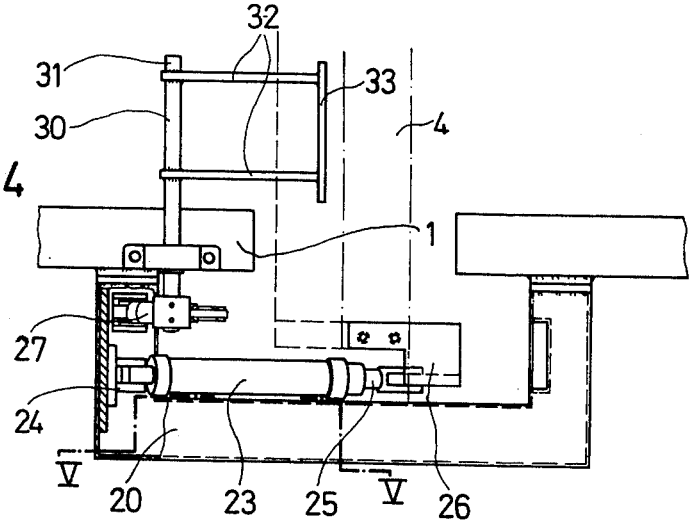
FIG. 4 shows a detail of the device shown in FIG. 1.

For convenience FIG. 4 shows only part of the blankholder and in particular, only two of the struts 32; the blankholder 30 in fact extends over the whole width of the table 8. As mentioned above and shown in FIGS. 6 and 7 each clamp jack 22 is arranged on the upper side of the intermediate carrier 20. The clamp jack has a mounting hole 34 and a rigidly fixed stud which extends into the pick-up and bearing hole 21 in the lateral support 14 of the cutting tools 4 to 7 (see FIG. 5) to thereby provide a swivel axis for each of the cutting tools.

The cutting tools are also arranged to be adjustable with regard to the direction of the feed movement. A rod 35, pivotably supported in the intermediate carrier 20, cooperates with clamp jacks 22; this rod has at its upper end a stud 36 which faces the clamp jack 22, the stud being arranged eccentrically to the axis of the rod 35. The stud 36 is cooperative with a bearing, for instance, a roller bearing 37 mounted in an appropriate recess in the underside of clamp jack 22. At the other end of the rod 35 is fixedly mounted a swivel lever 48, which is connected with a corresponding swivel lever on the corresponding rod 35 of the opposite clamp jack 22, by means of a connecting rod 38 and adjustably studs 39. A bar 41 rigidly connected to the piston rod of working cylinder 40 connects to the rod 38 by means of a cantilever 42. Cantilever 42 is in turn, mounted on rod 38 which has a bore through which the bar 41 freely passes. Bar 41 also has a spring 43 and a spring 44, arranged on opposite sides of the bar 41 relative to cantilever 42. By laterally adjusting the connecting rod 38, the rod 35 is caused to rotate, and the eccentrically arranged stud 36 acts on bearing 37 to move jack 22. The displacement of clamp jack 22 is in the direction, or opposite to the direction of the feed movement of the sample pieces, or carpet web. In this manner the cutting tool associated with clamp jack 22 is also displaced. In order to insure precise displacement clamp jacks 22 are retained in corresponding rails 45, which are positioned on both sides of clamping rails 46.

FIG. 5 also shows in broken line a fixed cutting tool 47 with which the movable cutting tools 4 to 7 cooperates. The edge of the fixed blade is close to the swivel axis for the cutting tools 4 to 7.

Operation of the above machine to provide carpet sample pieces is as follows:

A carpet web is placed on table 8 and conveyed to cutting tool 4. Cutting tool 4 is moved downwards by working cylinder 15 to chamfer the edge, in this case the front edge, of the sample piece including the nap. To achieve this the cutting tool is orientated at an angle to the vertical according to the desired chamfer, preferably by 45°, this orientation being to the left as viewed in FIG. 2. The cutting tool 4 is then repivoted into the vertical position and the blade 10 is again displaced downwards by working cylinder 15, in order to cut the edge straight and vertical in the region of the base layer with the nap. The cutting tool then divides a strip from the carpet web, displacing it in feed direction A. The displaced strip is straightened perpendicular to the feed direction A, and simultaneously the next following edge is chamfered. The displaced strip then arrives at cutting tool 5, which after being swung around the horizontal pivot axis through an angle $\alpha$-in this case to the right, as viewed in FIG. 2 — chamfers the rear edge of the strip. After cutting tool 5 is repivoted to the vertical it cuts the edge straight and vertical in the region of the base layer.

The strips then pass on to the straightening station 9. If the straightening station 9 is filled-up with strips transverse to the feed direction A, the cylinders 18, 18', 18'' etc. provided at the straightening station 9 are lifted, pass between the conveyors 19, 19' etc., pick up the strips and push them in the direction of arrow B, towards cutting tool 6. The chamfering and dividing process repeats at cutting tool 6 and cutting tool 7. After cutting tool 7, the work pieces which were conveyed as strips to cutting tool 6, emerge as sample pieces of the desired dimensions, and chamfered at their edges.

The individual movements of the cutting tools, of the blankholder, etc., which are commanded by working cylinders, are effected by an electro-pneumatical control system. Thereby, the individual control motions are timed and coordinated with each other. The length of the feed step and/or the moment of the cutting movement of the cutting tool 4 to 7 is adjustable, in order to cut sample pieces of desired dimensions. If changing the dimensions of the sample pieces, it is not necessary to change the tools. This kind of precision of the cutting and of chamfering of the edges, could not be achieved by hand cutting. In addition, using a linearly moving cutting stroke eliminates frictional overheating at the location of the cut edges so that there are no smears at the sample edges. Also even the most delicate carpet webs can be cut in this way without any damage to the carpet structure.

The straightening station 9 could alternatively comprise a turning plate, which swings the strips conveyed there by 90°, so that the strips, pivoted and now parallel to feed direction A, can be further conveyed in this feed direction. In this case, the conveying table would be elongated and need not be angled in an L-shape.

Figure 6:
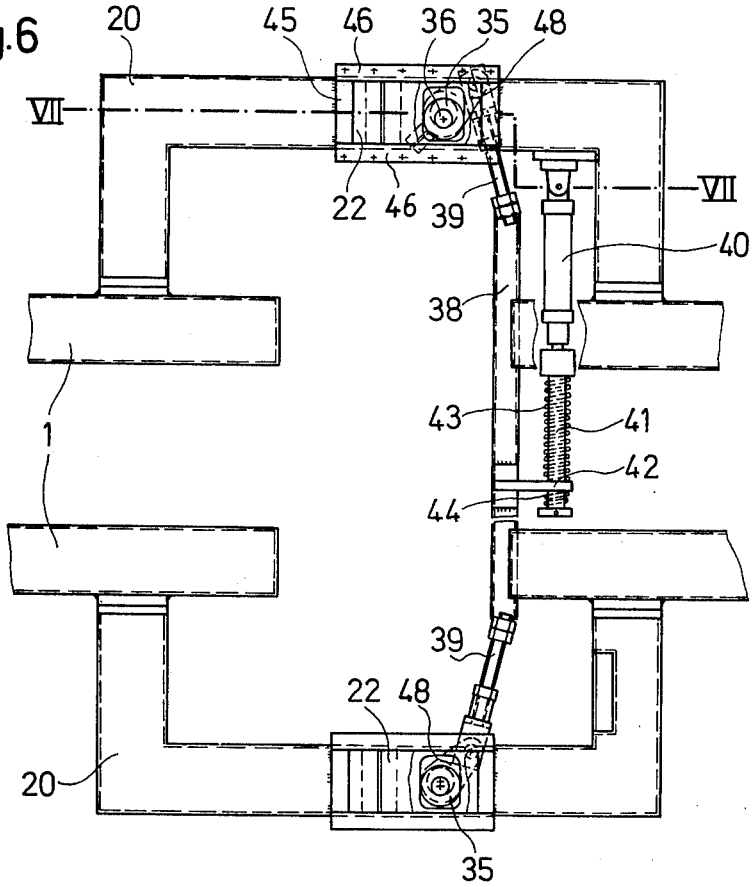
FIG. 6 is a top view of the device as per the invention within the scope of the enlarging of the main frame; and, FIG. 7 is a side view of the object as shown in FIG. 6, in the section as per the cutting line VII — VIII in FIG. 6.
Figure 7:
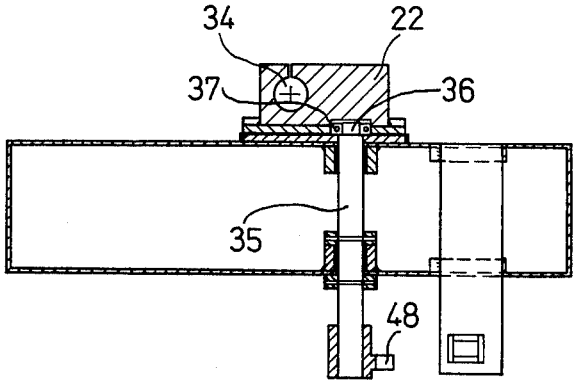

The displacement of the cutting tools and their blades in the direction of the feed movement of the work piece, as referred to in FIGS. 6 and 7, is for the purpose of adapting the cutting tools to the various heights of the work pieces and especially to the ratio total height of carpet with height of nap. In this way, it is realized that the position of the vertical cut must be adjustable whereby the joint between it and the chamfering of the nap, is in such a position that the carpet piece is chamfered within the scope of the nap, but is cut straight, i.e., vertically within the scope of the base layer. The individual displacement and adaption to the height ratio of the base layer/nap during the cutting process can be achieved for instance, by means of a hand wheel or the like. This displacement of the cutting tools is made between the cut for the chamfering and the vertical cut and so effects a displacement of the swivel axis, consequently a kind of zero point adjustment of the cutting tools.

What we claim is:

1. A device for progressively dividing carpet webs comprising a main frame; a conveying table mounted on the main frame and on which the carpet web will be supported and fed; four cutting tools, each pivotable about an axis transverse to the direction of the feed at that cutting tool, for cutting the carpet web into sample pieces and for chamfering the cut edges thereof, said cutting tools being arranged into a first pair for fashioning two opposite edges of the sample pieces and a second pair for fashioning the other two opposite edges of the sample pieces; and, between said first and second pairs of cutting tools, a straightening station for aligning carpet strips produced by the first pair of cutting tools in the direction of feed into the second pair of cutting tools.

2. A device according to claim 1, wherein the conveying table in plan view is of substantially L-shaped configuration with substantially right-angle change of the feed direction wherein the straightening station is located in the region of the junction of the two legs of the L-shaped, said straightening station comprising a plurality of liftable and lowerable cylinders arranged parallel to a first and consequently transverse to a second feed direction, these cylinders being arranged to pass vertically through a conveying device for the first feed direction and wherein to each of the two table legs is allocated a pair of said cutting tools for first cutting and chamfering the front and rear edge of the sample pieces, and for then cutting and chamfering the two lateral edges of the sample pieces.

3. A device according to claim 2 wherein the length of the cylinders of said straightening station corresponds substantially to the width of the conveying table.

4. A device according to claim 1, wherein the cutting tools each comprise an elongate blade arranged transverse to the table and provided with a cutting edge and an associated stationary blade for cooperation with said elongate blade.

5. A device according to claim 4 wherein the elongate blade of the cutting tools are guided on both sides in columns arranged within the support.

6. A device according to claim 1, wherein each cutting tool is arranged within a support which is formed by lateral supports pivotably mounted on the main frame and by a cross-piece extending between the lateral supports and rigidly connected with same.

7. A device according to claim 6, wherein on the cross-piece is arranged a first working cylinder, the piston of which is connected with the elongate blade of the cutting tool by a piston rod.

8. A device according to claim 1 wherein the main frame consists of hollow sections which are rectangular in cross-section.

9. A device according to claim 1 wherein the main frame is enlarged in the regions of the cutting tools.

10. A device according to claim 9, wherein the enlarged parts of the main frame are formed as U-shaped intermediate carriers, laterally projecting from the main frame and bridging over the main frame which is interrupted in these regions, the intermediate carriers having a rectangular hollow section.

11. A device according to claim 10, wherein a clamp jack is arranged on the upper side of each intermediate carrier, each clamp jack having rigidly fixed thereto a stud, said studs cooperating with corresponding bearings in the lateral supports of the support thereby forming the swivel axis for the cutting tools.

12. A device according to claim 11, wherein means are provided for displacing said clamp jacks, and consequently said cutting tools, in the direction of the feed at said cutting tools, said means comprising a pair of swivel rods, each swivellably mounted on one of the intermediate carriers and having at an upper end thereof an eccentrically arranged swivel stud which engages in a recess in the underside of the respective clamp jacks, and also having a lever rigidly fixed thereto, said lever being coupled by a reciprocal coupling comprising at least one connecting rod, and a working cylinder being coupled to said mechanical coupling.

13. A device according to claim 9 further comprising means to pivot the cutting tools about a horizontal axis to thereby chamfer the edges of the sample piece, said means comprising a working cylinder and an intermediate carrier, the working cylinder being pivotally connected at one end to the intermediate carrier, the working cylinder having a piston rod which piston rod is hinged to a support carrying the cutting tool.

14. A device according to claim 13, wherein at the side of the third working cylinder adjacent to the support is arranged a fourth working cylinder pivotally connected at one end to the intermediate carrier, the piston of which engages with a swivel lever which is rigidly connected with a blankholder which is arranged to press the carpet web or strip pieces to the conveying table, during the cutting and chamfering process.

15. A device according to claim 14 wherein the blankholder comprises a series of struts rigidly fixed to a swivel bar the free ends of which carry a holding bar adjacent to the work piece.

* * * * *